United States Patent [19]

Trenne

[11] 4,206,728

[45] Jun. 10, 1980

[54] HYDRAULIC VALVE ACTUATOR SYSTEM

[75] Inventor: Myron U. Trenne, Rochester, Mich.

[73] Assignee: General Motors Corporation, Detroit, Mich.

[21] Appl. No.: 901,452

[22] Filed: May 1, 1978

[51] Int. Cl.[2] ..... F04B 3/00

[52] U.S. Cl. ..... 123/90.12; 123/90.11

[58] Field of Search ..... 123/90.11, 90.12, 90.15

[56] References Cited

U.S. PATENT DOCUMENTS

| | | | |
|---|---|---|---|
| 2,011,864 | 8/1935 | Lundh | 123/90.12 |
| 2,827,884 | 3/1958 | Stivender | 123/90.12 |
| 2,915,052 | 12/1959 | Gullen | 123/90.11 |
| 3,257,999 | 6/1966 | Fiedler | 123/90.12 |
| 3,682,152 | 8/1972 | Muller-Berner | 123/90.11 |
| 3,727,595 | 4/1973 | Links | 123/90.12 |
| 3,861,833 | 1/1975 | Salzgeber et al. | 417/254 |
| 3,865,088 | 2/1975 | Links | 123/90.12 |
| 3,926,159 | 12/1975 | Michelson et al. | 123/90.11 |
| 4,009,695 | 3/1977 | Ule | 123/90.13 |

*Primary Examiner*—Charles J. Myhre
*Assistant Examiner*—Raymond A. Nelli
*Attorney, Agent, or Firm*—Arthur N. Krein

[57] ABSTRACT

A hydraulic valve actuator system for an internal combustion engine in which an engine driven pump means supplies fluid, at high pressure, sequentially to an N number of outlets, each outlet being connected by a check valve and a fluid delivery conduit to an associated actuator means for a poppet valve in a set of N number of poppet valves for the engine, each actuator means including an actuator plunger reciprocably journaled in an actuator cylinder with one end of the actuator plunger positioned for abutment against the stem of an associated poppet valve that is normally held closed by an associated valve return spring. Each fluid delivery conduit is also connected via a drain conduit to a fluid reservoir used to supply fluid at a predetermined supply pressure to the inlet of the pump means, flow from each delivery conduit through its associated drain conduit being controlled by an associated normally open, solenoid valve connectable to an electric control circuit whereby each solenoid valve can be sequentially energized as a function of engine operating perimeters.

3 Claims, 4 Drawing Figures

HYDRAULIC VALVE ACTUATOR SYSTEM

FIELD OF THE INVENTION

This invention relates to internal combustion engines or similar mechanisms and, in particular, to a hydraulic valve actuator system for controlling the valve operation in such an engine or similar mechanism.

DESCRIPTION OF THE PRIOR ART

In most conventional present day internal combustion engines, breathing of the engine, that is both inlet to and exhaust from an engine, is controlled by means of poppet valves suitably actuated by means of a valve drive train actuated by a camshaft of the engine.

Various attempts have been made to provide for improved control of valve actuation in internal combustion engines by the use of hydraulic mechanisms to effect valve operation in lieu of a conventional valve drive train. To this end, various mechanisms of the type using a hydraulic cylinder and piston combination for effecting valve actuation in an engine have been proposed in the prior art, such mechanisms of this type appropriately being referred to as hydraulic valve actuator mechanisms or systems.

Differing arrangements of one form of such hydraulic valve actuator systems are disclosed, for example, in U.S. Pat. Nos. 1,692,845 entitled "Internal Combustion Engine" issued Nov. 27, 1928 to George A. Kolb; 2,011,864 entitled "Pump" issued Aug. 20, 1935 to Sverrer H. Lundh; 2,602,434 entitled "Hydraulic Valve Operating Mechanism Operable to Vary Valve Lift and Valve Timing" issued July 8, 1952 to James C. Barnaby, and 3,257,999 entitled "Hydraulic Control for Internal Combustion Engines, in Particular for Gas Engines" issued June 28, 1966 to Franz Fiedler.

In such systems as disclosed in the above-identified United States patents, a control pump driven by the engine is used to intermittently supply high pressure fluid via a check valve and a delivery pipe to one side of a hydraulic cylinder having a piston reciprocably journaled therein whereby the piston can be actuated in one direction to affect opening of a poppet valve against the bias of the usual valve spring effecting normal closing of the poppet valve. The control pump in such a system is usually a conventional type of fuel injection pump, as used, for example, to supply pressurized fuel in the fuel injection system of a diesel engine, and, as well known, a single control pump may be used to supply the hydraulic fluid for actuation of a plurality of poppet valves in a set of valves for the engine or, alternatively, individual pumps, of the so-called jerk type commonly used to effect fuel injection in diesel engines, may be used for each poppet valve of the engine.

However, none of the known prior art hydraulic valve actuator systems provide control of valve lift, valve duration, and valve timing in a simple, inexpensive arrangement that can be readily incorporated into an engine or similar mechanism.

SUMMARY OF THE INVENTION

This invention relates to a hydraulic valve actuator system of the type having an engine driven control pump, similar in construction to a conventional fuel injection pump, that is used to intermittently supply a metered quantity of pressurized hydraulic fluid, as a function of engine operation, to a hydraulic valve actuator cylinder having a piston therein positioned to abut against the stem of a poppet valve to effect opening movement of a poppet valve that is normally held in a closed position by a valve return spring. Each delivery conduit connecting an outlet of the control pump to a hydraulic valve actuator cylinder is also connected, intermediate its ends, to a relatively low pressure fuel drain conduit, with flow through the drain conduit being controlled by a normally open, solenoid valve connectable to a suitable electrical control circuit which is operative to effect sequential energization of that solenoid valve as a function of engine operation, as predetermined for a particular engine.

It is therefore a primary object of this invention to provide a hydraulic valve actuator whereby valve lift, timing and valve duration can be controlled, as desired, for effective and economic engine operation.

Another object of this invention is to provide a hydraulic valve actuator system that is operable to provide improved control of engine breathing over all engine speed and load operating conditions.

A further object of this invention is to provide a hydraulic valve actuator system whereby an internal combustion engine can be operated with wide open throttle at the engine carburetor while controlling engine power output via inlet valve control by means of the subject system.

A still further object of this invention is to provide hydraulic valve actuator system for an internal combustion engine whereby the engine can be operated in a split engine mode by selective deactivation of engine valves.

For a better understanding of the invention as well as other objects and further features thereof, reference is had to the following detailed description of the invention to be read in connection with the accompanying drawings, wherein:

DESCRIPTION OF THE PREFERRED EMBODIMENT

Figure 1:
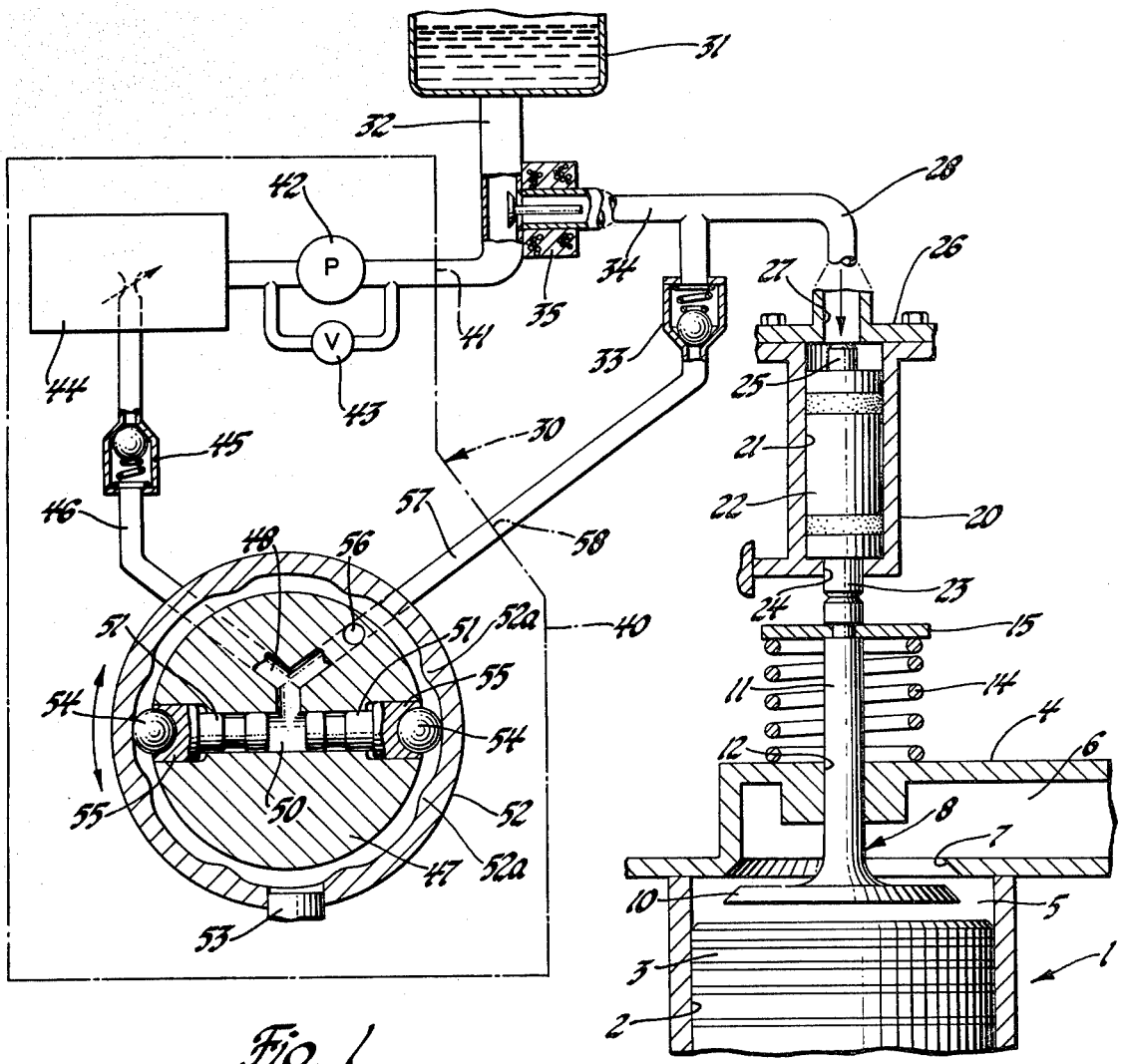
FIG. 1 is a schematic illustration of a portion of an internal combustion engine having a hydraulic valve actuator system, in accordance with the invention incorporated therein.

Referring now to FIG. 1, there is shown schematically a portion of an internal combustion engine 1 having, in the construction illustrated, a plurality of longitudinally aligned cylinders 2, only one of which is shown, each such cylinder 2 having reciprocably disposed therein a piston 3 operatively connected to the engine crankshaft, not shown. Mounted on the cylinder block and enclosing the upper ends of the cylinders 2 is a cylinder head 4 which cooperates with the cylinders to define combustion chambers 5 and includes passages 6, each of which terminates at one end in a port 7 opening into an associated combustion chamber 5. Each such port 7 is closeable by an outward opening poppet valve 8.

Each poppet valve 8 which may be either an intake valve or an exhaust valve, is of conventional construction and includes a valve head 10 with a valve stem 11 extending therefrom that is suitably journaled and guided in a valve stem guide bore 12 in the cylinder head 4 whereby the head 10 of the poppet valve can be moved into and out of engagement with the valve seat encircling and forming part of a port 7. Each such poppet valve 8 is normally biased to a closed position relative to its associated port 7 by means of a valve return spring 14 bearing upwardly from the cylinder head 4 against a spring retainer 15 locked, in a well known manner, to the valve stem 11 closely adjacent to its free end.

Suitably supported above each of the poppet valves 8 is a hydraulic actuator means that includes an actuator housing 20 which may be formed as part of the cylinder head 4 or, as shown, as a separate element. Housing 20 is provided with hydraulic valve actuator cylinders 21 therein, the axis of each such actuator cylinder 21 being aligned with the axis of the valve stem 11 of the poppet valve 8 with which it is associated. An actuator plunger or piston 22 is reciprocably journaled in each of the actuator cylinders 21, whereby each such actuator cylinder 21 and actuator piston 22 forms, in effect, a valve actuator. Each actuator piston 22 is suitably structured so that one end thereof, its lower end with reference to FIG. 1, operatively abuts against the free end of the valve stem 11 with which it is associated. Thus, in the construction illustrated, each actuator piston 22 has a reduced diameter extension 23 at its lower end that slidably projects outward through an opening 24 provided in the lower end of the actuator housing 20 in axial alignment with the associated actuator cylinder 21. Also in the construction illustrated, each actuator piston 22 is provided at its opposite or upper end, with reference to FIG. 1, with a pilot plunger 25 of predetermined diameter and axial length for a purpose to be described.

Each actuator cylinder 21 in the housing 20 is partly closed at its upper end, with reference to FIG. 1, by a housing cylinder head 26 having a passage 27 therethrough, opening into that actuator cylinder 21. This end of each passage 27 opening into an actuator cylinder 21 is of a predetermined internal diameter so as to loosely receive the pilot plunger of the associated actuator piston 22. The opposite end of each passage 27 is suitably connected to one end of an associated delivery conduit 28 whereby the associated actuator cylinder can be intermittently supplied with a metered quantity of hydraulic fluid, such as oil, in a manner to be described, whereby, as a predetermined hydraulic force is applied against the actuator piston 22, it will be moved in a power stroke direction to affect opening movement of the poppet valve 8, and when this force is reduced sufficiently, the valve return spring 14 will affect reseating or closure of the poppet valve 8 and, at the same time, cause movement of the actuator piston 22 in a return stroke direction.

In the embodiment disclosed, pressurized hydraulic fluid is intermittently supplied to each actuating cylinder 21 via its associated delivery conduit 28 by an engine driven distributor pump, generally designated 30, which in turn is supplied with hydraulic fluid from a fluid reservoir 31 via a supply conduit 32.

In accordance with the invention, each delivery conduit 28 is connected intermediate the one-way check valve 33 controlling flow through this conduit and its connection to an associated actuator cylinder 21 by a drain conduit 34 to the supply conduit 32 intermediate the ends thereof, with flow through the drain conduit 34 to the supply conduit 32 being controlled by a normally opened, solenoid valve 35.

For a purpose which will become apparent, the fluid reservoir 31 should either be located in the manner shown to act as an accumulator to provide a slightly pressurized column of fluid in the supply conduit 32 so as to prevent complete drainage of fluid from the associated delivery conduit 28 when the associated solenoid valve 35 is open or alternately, the fluid reservoir 31 should be in the form of a low pressure type accumulator chamber, not shown. As a further alternate, the fluid reservoir 31 can be located as desired and a low pressure supply pump, not shown, can be used to deliver fluid from the fluid reservoir 31 to the pump 30 through the supply conduit 32 at a predetermined low supply pressure in the same manner as currently used in certain diesel engine powered vehicles. In this second alternate construction, such a supply pump should be located, for example, in the supply conduit 32 up stream of the solenoid valve 35 controlled flow opening from the drain conduit 34 thereto.

Distributor pump 30 may be any suitable type positive displacement pump such as those presently available for use in diesel fuel injection systems. Accordingly, the distributor pump 30 may be of the type disclosed in U.S. Pat. No. 3,648,673 entitled "Fuel Injection Pump" issued Mar. 14, 1972 to Richard S. Knape or, as schematically shown, the pump may be of the type disclosed, for example, in U.S. Pat. No. 3,861,833 entitled "Fuel Injection Pump" issued Jan. 21, 1975 to Daniel Salzgerber, Robert Raufeisen and Charles W. Davis. This later type pump is, in effect, an engine driven inlet-metering, distributor type pump having a built-in governor and automatic advance mechanism whereby the pump is operative to provide timed delivery of metered quantities of pressurized fluid as a function of engine operation.

As is known, a pump of the type disclosed in the above identified U.S. Pat. No. 3,861,833 includes a pump housing 40 having an inlet 41 connected to the common supply conduit 32 through which fluid flows to an internal transfer pump 42. Since the displacement of the transfer pump 42 greatly exceeds final pump 30 discharge requirements, a large percentage of fluid delivered by the transfer pump is by-passed back to the inlet side of the transfer pump 42 through a by-pass means having a pressure regulating valve 43 therein which causes both the amount of fluid by-passed and transfer pump 42 discharge pressure to increase with engine speed. A portion of the fluid discharged from the transfer pump is forced through a metering valve 44, as regulated by engine demand through a governor arrangement, not shown. From the metering valve 44, fluid flows through a check valve 45 in a passage 46 to a distributor rotor 47 rotatably journaled in housing 40 and driven in a suitable manner, not shown, by engine 1, as is the transfer pump 42. With this arrangement, pump operation is synchronous with engine 1 operation. When one of the charging port passages 48 in the rotor 47 comes into register with the passage 46, fluid flows into the injection pump chamber 50 in rotor 47.

The injection pump chamber 50 is formed by a pair of intersecting transverse bores in the rotor 47. A pair of opposed plungers 51 are mounted for reciprocating movement in these bores. Surrounding the distributor rotor 47 is a generally annular internal cam ring 52, which, in turn is journaled in housing 40 for limited arcuate movement and is moved by means of an advanced mechanism, not shown, to which it is operatively connected by means of a connecting pin 53. The advanced mechanism, not shown, is operative whereby delivery of fuel by the injection pump from the injection pump chamber 50 will be varied as a function of engine operation. Cam rollers 54 and cam roller shoes 55 are carried by the rotor 47 between the plungers 51 and the cam ring 52.

When metered fuel is admitted to the injection pump chamber 50, the plungers 51 move radially outward, as required, to receive the charge of fluid delivered thereto. At that time, the cam rollers 54 are positioned between adjacent cam lobes 52*a* of the cam ring 52. Rotation of rotor 47 then causes the charging port passage 48 to pass out of registry with passage 46 and, as the distributing passage 56, shown schematically, comes into registry sequentially with one of a plurality of passages 57 to the outlets 58, cam rollers 54 simultaneously contact opposite lobes 52*a* of the cam ring 52 to effect reciprocable motion of the plungers 51 so as to pressurize the charge of fluid in the injection pump chamber 50 on the inward stroke of the plungers 51 to some predetermined high pressure. This pressurized fluid is, of course, then discharged via one of the passages 57 to its associated outlet 58 that, in turn, is connected to a delivery conduit 28, previously described. It should be noted that only one of the passages 57 and only one of the outlets 58 is shown in FIG. 1, it being realized that an N number of such passages and an N number of associated outlets would be provided on a particular embodiment of the distributor pump 30 for a particular engine application having an N number of cylinders.

It is believed that the foregoing description is sufficient for the purpose of this application to show the general operation of this particular type engine driven distributor pump 30. For further details concerning the specific construction of this type distributor pump 30, as shown, reference is made to the above-identified U.S. Pat. No. 3,861,833, the disclosure of which is incorporated herein by reference thereto.

For purposes of disclosure only, the engine 1 is referred to as a V-8 engine. It will thus be apparent that in such an engine there would be two banks of cylinders 2 and that the total of N number of cylinders in this engine would be eight. It will also be apparent that in such an engine it would be provided with at least an N number or eight inlet or intake poppet valves and at least an N number or eight outlet or exhaust poppet valves for controlling ingress of induction fluid to the cylinders 2 and egress of exhaust gas from the cylinder.

In such an engine, a first system, as shown in FIG. 1, with a first distributor pump 30 would be required to operate the N number of inlet valves and a second similar system with a second distributor pump 30 would be required to operate the N number of exhaust valves. The outlets 58 of each of the first and second distributor pumps would, of course, correspond in number to the N number of cylinders of the engine, with these outlets 58 supplied sequentially with pressurized fluid by the rotating distributor rotor 47 with the two plungers 51 (or sometimes four, as is well known) therein, as previously described, the plungers being driven by the cam lobes 52*a*, the number of which will also depend on the number of outlets in a particular pump, as is well known in the art. The distributor rotor 47, as well as the driven element of the transfer pump 42 of each distributor pump is suitably coupled to the engine 1 via a drive system, not shown, so as to operate at half engine crankshaft speed.

In the subject system, it is preferred that the check valves 33 and solenoid valves 35 are located in close proximity to the distributor pump 30 so that, in effect, a single hydraulic line is required to connect each remote valve actuator to the distributor pump 30. This hydraulic line is thus operative to accommodate fluid flow in both directions to facilitate valve opening and valve closing.

As previously described, the accumulator or reservoir 31 is operatively connected to each pump outlet check valve 33 and associated valve actuator by a normally open solenoid valve 35. Each such solenoid valve 35 is a normally open, so-called poppet type valve and it is used in such a manner so as to utilize the greatest magnetic holding force in the valve closed position and so as to release, when de-energized, very quickly due to hydraulic pressure attempting to unseat the valve thereof. As will be apparent, each solenoid valve 35 would be connected to a suitable source of electric power, not shown, through a suitable valve timing electrical computer control device, whereby these solenoid valves 35 can be sequentially energized in a predetermined manner as a function of engine operation and/or operator input, as predetermined. Since the details of a suitable valve timing control device and its operation is not deemed necessary for an understanding of the subject invention, such a device has not been disclosed herein, especially in view of the fact that such control devices are well known in the electronic art as associated with the fuel injection system, for example, of automotive engines as shown, for example, in U.S. Pat. Nos. 3,240,191, Wallis and 3,817,099, Bubniak et al, and a description of such a device is not deemed necessary for an understanding of the subject invention.

As previously described, each valve actuator, consists of a hydraulic piston 22 that is operative to generate a downward force on an associated valve 8 when fluid pressure is applied to the upper end, with reference to FIG. 1 of the piston 22. The applied fluid pressure is predetermined and is always sufficient to overcome resisting forces of the valve return spring 14, friction, and cylinder pressure because of the positive displacement nature of the system. The use of a valve actuator in conjunction with a conventional valve return spring 14, provides, in effect, a hydraulic pump on the return stroke of the valve 8. Thus, hydraulic energy is conserved by storing the energy return on the return stroke of the valve actuator in the pressure accumulator or reservoir 31. It will readily be apparent that the valve return spring 14 should have sufficient force to assure that the valve 8 will fully return to its closed position and so that it can not be unseated by residual pressure in the conduit 28 when the associated solenoid valve 35 is open. The pilot plunger 25, previously described, is included on the actuator piston 22 so as to orifice the flow of fluid from the actuator cylinder 21 during the final portion of the return stroke of the actuator piston 22 therein whereby to provide a hydraulic cushion for gentle seating of the valve 8 against its valve seat and to effect a reduction in noise.

In the operation of the subject hydraulic valve actuator system, valve lift control and valve timing control is achieved by normal operation of the engine driven, distributor pump 30, while valve duration control is achieved by operation of the solenoid valves 35, as follows:

Valve Lift Control

Figure 2:
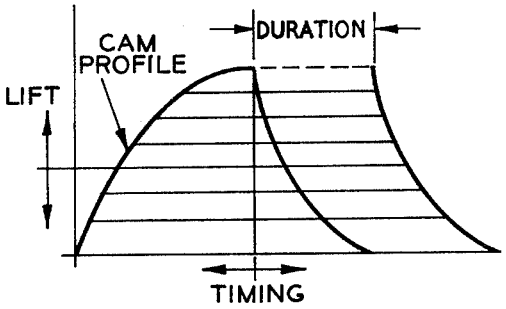
FIG. 2 is a generalized set of curves of valve lift versus valve timing showing the intended application of the subject hydraulic valve actuator system in an engine.

Valve lift control is achieved in the subject system through the operation of the metering valve 44 of the distributor pump 30. The quantity of fluid admitted by the metering valve during the suction stroke of plungers 51 determines the amount of valve 8 displacement per stroke in a 1:1 manner. The valve 8 lift will thus occur in a manner that maintains the maximum lift point in a constant relationship to piston 3 position. Thus, at a given time setting, maximum valve lift will always occur at the same point (e.g. 90°) regardless of amount of lift as shown in FIG. 2. This feature provides inherent advance of valve opening as greater valve lifts are generated in response to system controls.

Valve Timing Control

Valve timing control in the subject system is achieved by rotation of the cam ring 52 with respect to the engine crankshaft in a manner described in detail in the above-identified U.S. Pat. No. 3,861,833. Movement of the cam ring 52 sets the point when the plungers 51 contact the cam lobes 52*a* at which time lift of an engine valve 8 begins. Although a particular mechanism has been shown in the above-identified U.S. Pat. No. 3,861,833 to effect rotation of the cam ring 52 as a function of engine operation, various other types of vacuum or electrical actuators can be used, as known in the art, to effect rotation of such a cam ring 52 in this type distributor pump 30.

Valve Duration Control

Valve duration control is achieved by the associated solenoid valve 35 for each valve 8. The electrical control device, not shown, is operative so that the solenoid valve 35 must be energized (closed) when its associated valve 8 lift begins. When maximum valve lift is attained, the distributor pump 30 output check valve 33 locks a holding pressure on the associated valve actuator and holds that associated valve 8 open against the force of its valve return spring 14. When this solenoid valve 35 is de-energized, the hydraulic lock is lifted and then the associated valve return spring 14 is operative to return that valve 8 to its seated or closed position, and at the same time to act against the associated actuator plunger 22 to effect a return stroke thereof whereby to force the fluid back to the accumulator or reservoir 31. Thus, the valve lift profile follows the profile of the cam lobes 52*a* as seen in FIG. 2 and valve opening time become a function of engine speed. In contrast, valve closing time is a hydraulic function that remains constant over the engine speed range. Valve duration control, as shown in FIG. 2, simply delays hydraulic release for the desired time or degrees of crankshaft position.

Figure 3:
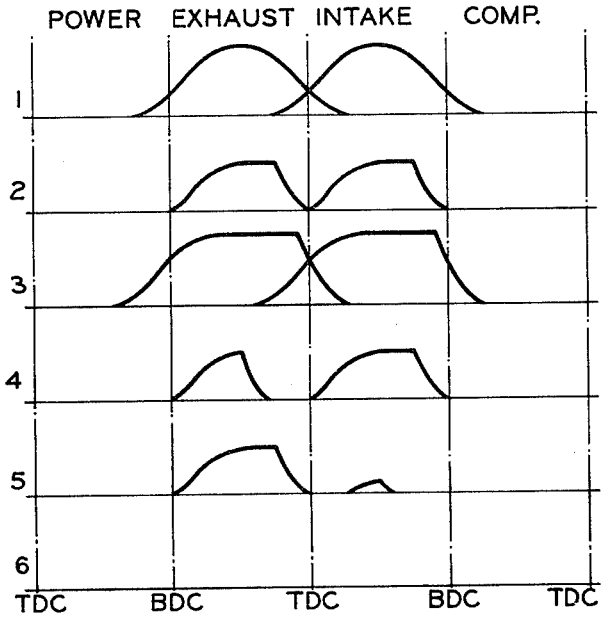
FIG. 3 is a graph of a series of six representations of valve operation in an engine provided with separate hydraulic valve actuating systems for the intake and exhaust valves of the engine; and, FIG. 4 is a block diagram of the mechanical and electrical controls for an internal combustion engine equipped with two hydraulic valve actuator systems in accordance with the invention for controlling both the intake valves and exhaust valves of the engine.

Referring now to FIG. 3, there is shown a series of six representations of both intake and exhaust valve operation, that can be programmed as desired, for an engine equipped with separate hydraulic valve actuator systems, in accordance with the invention, for the intake valves and exhaust valves of the engine. Line one of FIG. 3 illustrates typical valve operation over the full range of speeds and loads for a conventional fixed camshaft engine. Lines two thru six of FIG. 3 illustrate a variety of operating modes using "Valve Lift, Timing, and Duration Control" by use of hydraulic valve actuator systems as disclosed herein.

Thus, for example, line two of FIG. 3 illustrates part-power operation for low to mid speed engine operating conditions. The objective of this type valve programming is to eliminate valve overlap and maximize both the expansion ratio and the compression ratio of the engine for efficiency and economy.

Line three of FIG. 3 illustrates a maximum power, high speed engine operation which is utilizing maximum valve lift as well as advanced opening and retarded closing of both intake and exhaust valves. The curves in line three are those typical of a high performance engine camshaft.

Line four of FIG. 3 is another illustration of part-power engine operation showing the early closing of the exhaust valve whereby to trap residual exhaust gases and thereby accomplish, in effect, internal exhaust gas recirculation.

Line five of FIG. 3 illustrates a low speed, low power, engine operating condition where a very limited lift of the intake valve is combined with early closing to restrict the intake of a combustion mixture into the combustion chamber of the engine. This mode of operation of the intake valve accomplishes the throttling of the engine and is operative to reduce engine pumping losses because the throttling can be restricted to a very brief time period.

Line six of FIG. 3 illustrates a by-passed cylinder operating in a split engine mode, that is, a condition wherein both the intake valve and exhaust valve for a particular cylinder are deactivated. Operating the engine on reduced cylinders by means of the subject hydraulic valve actuator systems complements the function shown in line five of FIG. 3 by maintaining the operating points of the remaining operating cylinders in a range that is readily controlled by variable valve operation as disclosed herein.

It will be apparent to those skilled in the art that the subject hydraulic valve actuator system when used to control operation of the intake valves is operative to provide effective intake valve throttling for a sonic throttling intake valve engine as disclosed, for example, in U.S. Pat. No. 3,422,803 entitled "Internal Combustion Engine Construction and Method for Operation with Lean Air-Fuel Mixtures" issued Jan. 21, 1969 to Donald L. Stivender. Although preferably in such a sonic throttling intake valve engine separate systems, in accordance with the invention, would be used for both the intake and exhaust valves, if desired, a conventional actuating mechanism could be used to effect operation of the exhaust valves.

Figure 4:
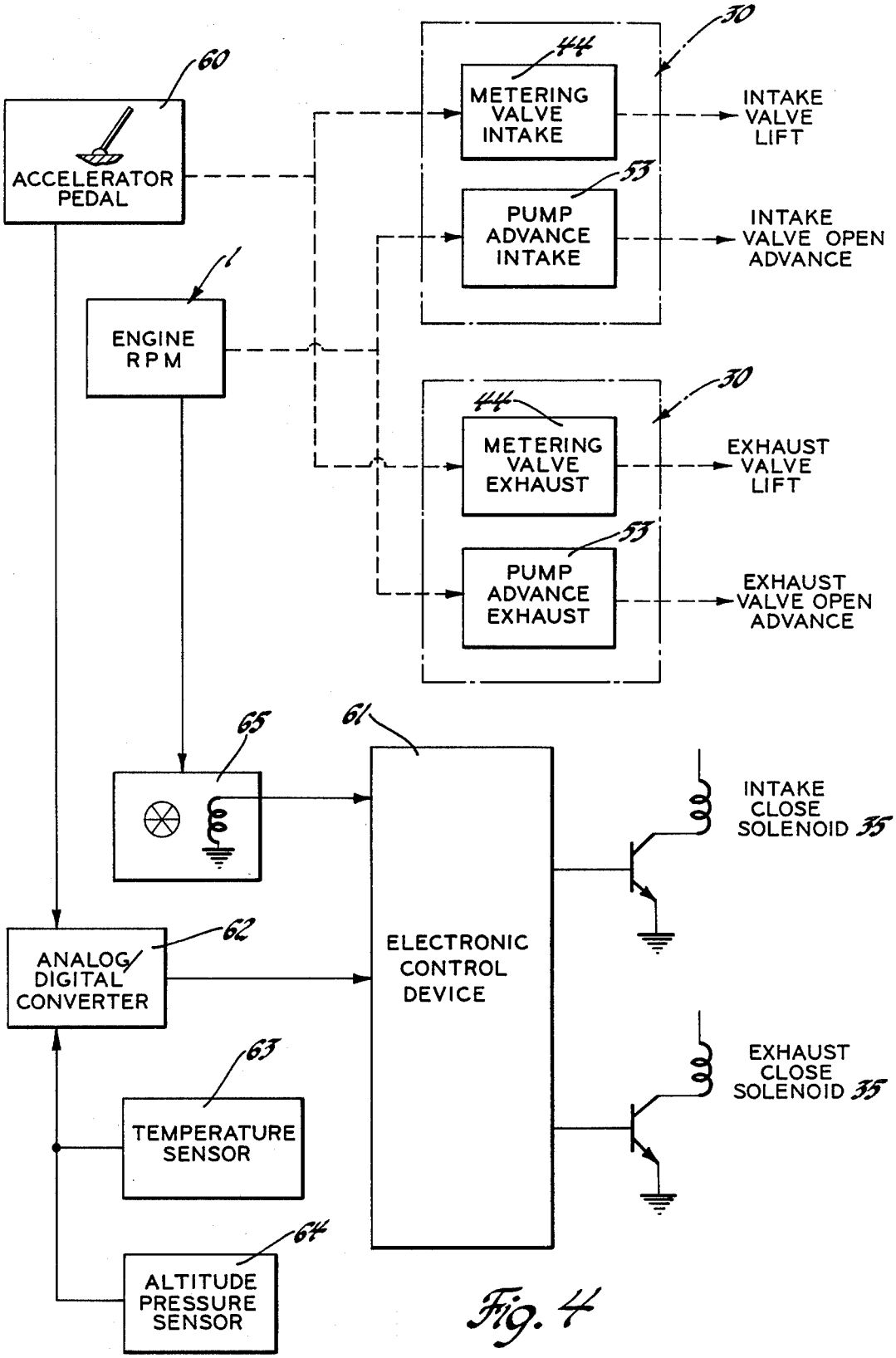

Referring now to FIG. 4 which is a block diagram of a control system for the operation of both the inlet valves and exhaust valves of an engine using the normal operating characteristic of a pair of engine driven distributing pumps 30 in separate hydraulic valve actuator systems for the inlet valves and exhaust valves for controlling the valve lift and timing of these valves supplemented by the electronic control of the solenoid valves 35 in each system to regulate valve open duration.

As shown in FIG. 4, an operator actuated accelerator pedal 60 is mechanically connected in a known manner to each distributor pump 30 to control operation of the metering valve 44 of each pump 30 and, an electrical signal is generated proportional to accelerator pedal 60 position. Since this signal is typically analog and the electronic control device 61 is typically a digital electronic processor, an analog/digital converter 62 is used to convert the analog signal to a digital signal applied to the electronic control device 61. In the control system shown, two additional analog inputs are also shown as being multiplexed into the analog/digital converter, one such input being applied by a temperature sensor 63 and the other input being applied by an altitude pressure sensor 64.

Temperature compensation is used to delay inlet valve closing with increasing temperature to compensate for reduced density of air at elevated temperatures. Altitude compensation is based on an absolute pressure transducer that would also delay inlet valve closing for reduced pressures (and density) of the induction air.

An engine revolution per minute (RPM) signal can typically be tapped off the usual sensor 65 for the ignition system of the engine, which generates four pulses per revolution of a V-8 engine. These pulses would be counted in the electronic control device 61 for a preselected time period to determine engine speed. The electrical signal inputs of accelerator pedal position and RPM would identify a unique value of crank angle for precise closing of the valves. When the engine is operating in a split mode, the accelerator pedal 60 input would be doubled in the electronic control device 61 to determine the proper closing event for the cylinders remaining in operation, that is, 30% accelerator pedal movement (all cylinders operating) corresponds, for example, to 60% accelerator pedal position for half the cylinders in operation. The crank angle to trigger valve closing may be based on a proportion of time between distributor pulses or it may be based on a toothed sensor of sufficient resolution to establish a crank angle for valve closing, that is, a sensor of the type used in a conventional electronic spark timing system. The parameters of temperature and altitude operate on the selected crank angle by adding degrees (delay) to compensate for reduced air density, as previously described.

It will be apparent to those skilled in the art that various modifications can be made in the subject hydraulic valve actuator system without departing from the scope of the invention disclosed. For example, the usual governor control input to the metering valve of the distributor pump 30 of the type disclosed in the above-identified U.S. Pat. No. 3,861,833 could be eliminated so that fluid metering is dependent solely on accelerator pedal position.

The embodiments of the invention in which an exclusive property or privilege is claimed are defined as follows:

1. A hydraulic valve actuator system for controlling the opening and closing of a set of valves associated with the cylinders of an internal combustion engine wherein the valves are normally closed by springs, said system including a set of actuator cylinders each with an actuator piston slidable therein for engagement with one of said valves to effect movement of said one of said valves when said actuator piston is reciprocated in a first direction, fluid delivery means for delivering fluid to said actuator cylinders to the end of said actuator pistons opposite said valves, said fluid delivery means including a low pressure fluid supply means, an engine driven high pressure, metering pump means having an inlet connected to said fluid supply means and a set of outlets and separate supply conduit means connecting said outlets to said actuator cylinders, and a set of normally open, solenoid valve controlled drain conduit means operatively connecting each of said supply conduit means to said fluid supply means, said metering pump means including metering and timing means for controlling the output and timing of output of said metering pump means to control lift and timing, respectively, of the lift of said valves, each said solenoid valve being operatively connectable to a controlled source of electrical power whereby to control duration of opening of said valves.

2. A hydraulic valve actuator system to effect movement of an N number set of spring biased, normally closed poppet valves of an engine, said system including an N number of valve actuator means each having an actuator piston reciprocably journaled in an actuator cylinder for operative engagement with an associated one of said poppet valves, a source of hydraulic fluid, an engine driven distributor type pump means having inlet means connected to said source of hydraulic fluid and providing an N number of outlets, said pump means being operative to deliver measured changes of liquid under high pressure sequentially to said outlets in timed relation to the operation of the engine, an N number of delivery conduit means, each said delivery conduit means being connected at one end to one of said outlets and at its other end operatively connected to an associated said actuator cylinder and each having a check valve therein positioned closely adjacent to an associated said outlet, an N number of drain passage means each having a normally open, solenoid valve connectable to an engine electrical control circuit for controlling flow through its associated drain passage means, each said drain passage means being connected in fluid communication at one end to one of said delivery conduit means intermediate the associated said check valve therein and the associated said actuator cylinder and at its other end to said source of hydraulic fluid whereby as pressurized fluid is delivered by said pump means to said delivery conduit means the fluid will be discharged out through the associated said drain passage means unless the associated said solenoid valve is energized whereby to block flow through said drain passage means so as to allow the pressurized fluid to act on the associated said actuator piston to effect opening of the associated said poppet valve until such time the associated said solenoid valve is again de-energized.

3. A hydraulic valve actuator system for use in an internal combustion engine having an engine housing means with an N number of cylinders each with a piston therein connected to the crankshaft of the engine, said engine housing means having at least a first set of passage means therein connected by ports to said cylinders, an N number of spring biased normally closed valves controlling flow through said ports, said system including a low pressure source of hydraulic fluid, an N number of actuator cylinder means in said engine housing means, an actuator piston in each said actuator cylinder means operatively connected to one of said valves, a metering distributor type pump having an inlet connected to said source of hydraulic fluid and an N number of outlets, an N number of conduit means each with a one-way valve therein connecting said outlets to said actuator cylinder means, said pump being operatively connectable to said crankshaft to be driven thereby for delivering measured quantities of hydraulic fluid under high pressure sequentially to each of said actuator pistons on the side thereof opposite said valves, and an N number of branch conduit means each with a normally open solenoid valve connectable to a control source of electrical power for controlling flow therethrough, each said branch conduit means being connected at one end to one of said conduit means intermediate said one-way valve therein and its associated said actuator cylinder means and at its other end being in flow communication with said source of hydraulic fluid.

* * * * *